US005366398A

United States Patent [19]

Meisenburg et al.

[11] Patent Number: 5,366,398

[45] Date of Patent: * Nov. 22, 1994

[54] MARINE DUAL PROPELLER LOWER BORE DRIVE ASSEMBLY

[75] Inventors: Gary L. Meisenburg; Edward C. Eick; Phillip D. Magee; Charles M. Mixon, all of Stillwater, Okla.; Robert B. Weronke, Oshkosh, Wis.; Waylon D. Shields; Woody R. Smith, both of Stillwater, Okla.; Steven J. Pavey, Carney, Okla.

[73] Assignee: Brunswick Corporation, Lake Forest, Ill.

[ * ] Notice: The portion of the term of this patent subsequent to Oct. 5, 2010 has been disclaimed.

[21] Appl. No.: 69,163

[22] Filed: May 28, 1993

Related U.S. Application Data

[63] Continuation-in-part of Ser. No. 889,530, May 27, 1992, Pat. No. 5,249,995, and a continuation-in-part of Ser. No. 69,162, May 28, 1993.

[51] Int. Cl.[5] ..... B63H 5/10

[52] U.S. Cl. ..... 440/81; 440/89; 440/75

[58] Field of Search ..... 440/66, 75, 76, 78, 440/79, 80, 81, 83, 88, 89; 416/129

[56] References Cited

U.S. PATENT DOCUMENTS

| | | | |
|---|---|---|---|
| 3,931,783 | 1/1976 | Croisant | 115/34 R |
| 3,952,686 | 4/1976 | Pichl | 115/17 |
| 4,529,387 | 7/1985 | Brandt et al. | 440/66 |
| 4,619,584 | 10/1986 | Brandt | 416/129 |
| 4,630,719 | 12/1986 | McCormick | 192/21 |
| 4,679,682 | 7/1987 | Gray, Jr. et al. | 192/21 |
| 4,698,036 | 10/1987 | Brandt | 440/62 |
| 4,741,670 | 5/1988 | Brandt | 416/129 |
| 4,764,135 | 8/1988 | McCormick | 440/83 |
| 4,773,215 | 9/1988 | Winberg et al. | 60/324 |
| 4,790,782 | 12/1988 | McCormick | 440/61 |
| 4,792,315 | 12/1988 | Karrasch | 440/83 |
| 4,795,382 | 1/1989 | McCormick | 440/81 |
| 4,832,635 | 5/1989 | McCormick | 440/78 |
| 4,832,636 | 5/1989 | McCormick | 440/80 |
| 4,840,136 | 6/1989 | Brandt | 440/78 |
| 4,863,406 | 9/1989 | Bland et al. | 440/83 |
| 4,869,121 | 9/1989 | Meisenburg | 74/323 |
| 4,869,694 | 9/1989 | McCormick | 440/83 |
| 4,871,334 | 10/1989 | McCormick | 440/89 |
| 4,897,058 | 1/1990 | McCormick | 440/80 |
| 4,900,281 | 2/1990 | McCormick | 440/78 |
| 4,948,384 | 8/1990 | Bland et al. | 440/78 |
| 4,993,848 | 2/1991 | John | 384/97 |
| 5,112,260 | 5/1992 | Bland et al. | 440/89 |
| 5,249,995 | 10/1993 | Meisenburg et al. | 440/81 |

*Primary Examiner*—Edwin L. Swinehart
*Attorney, Agent, or Firm*—Andrus, Sceales, Starke & Sawall

[57] ABSTRACT

A marine drive (10, 310) has two counter-rotating propellers (12 and 14, 312 and 314). Inner and outer concentric counter-rotating propeller shafts (40 and 42, 340 and 338) are supported by a spool (38, 336) in the lower horizontal bore (28, 328). Passages are provided in the housing for communicating lubrication and/or exhaust with the horizontal bore. Locking structure (50, 404) holds the driven gears and bearings in place in the lower horizontal bore.

5 Claims, 7 Drawing Sheets

MARINE DUAL PROPELLER LOWER BORE DRIVE ASSEMBLY

CROSS-REFERENCE TO RELATED APPLICATIONS

This application is a continuation-in-part of application Ser. No. 07/889,530, filed May 27, 1992, now U.S. Pat. No. 5,249,995, and application Ser. No. 08/069,162, filed May 28, 1993.

BACKGROUND AND SUMMARY

The invention relates to a marine drive having dual counter-rotating coaxial propellers.

Dual propeller marine drives with concentric counter-rotating propeller shafts are known in the prior art. The present invention provides improvements, including locking retaining structure for holding the lower dual propeller shaft assembly in the lower horizontal bore in the housing, lubrication and exhaust communication, durability, and performance.

The invention further relates to commonly owned copending allowed application Ser. No. 07/889,495, filed May 27, 1992, and allowed application Ser. No. 07/892,399, filed May 28, 1992, incorporated herein by reference.

DETAILED DESCRIPTION

Figure 1:
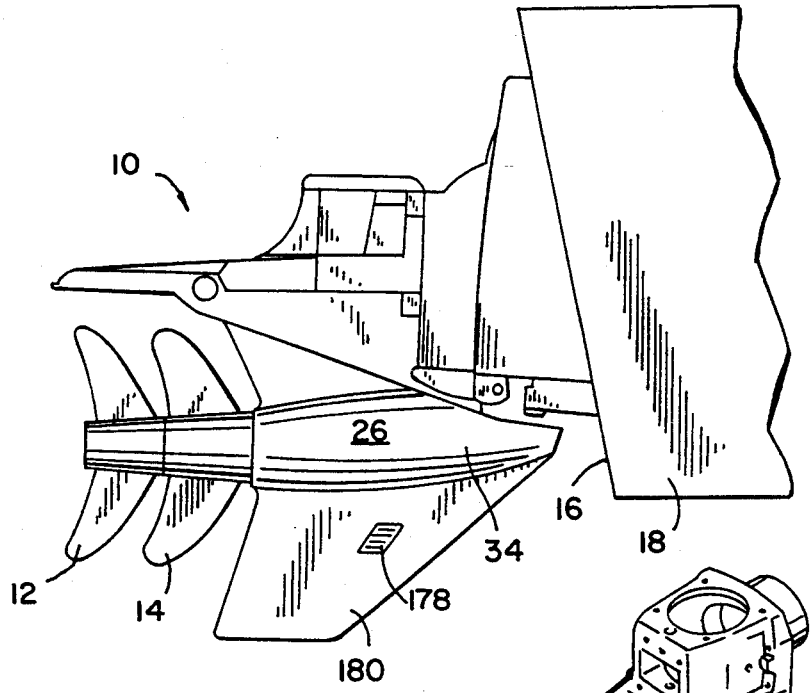
FIG. 1 is a side elevation view of a marine drive in accordance with the invention.
Figure 2:
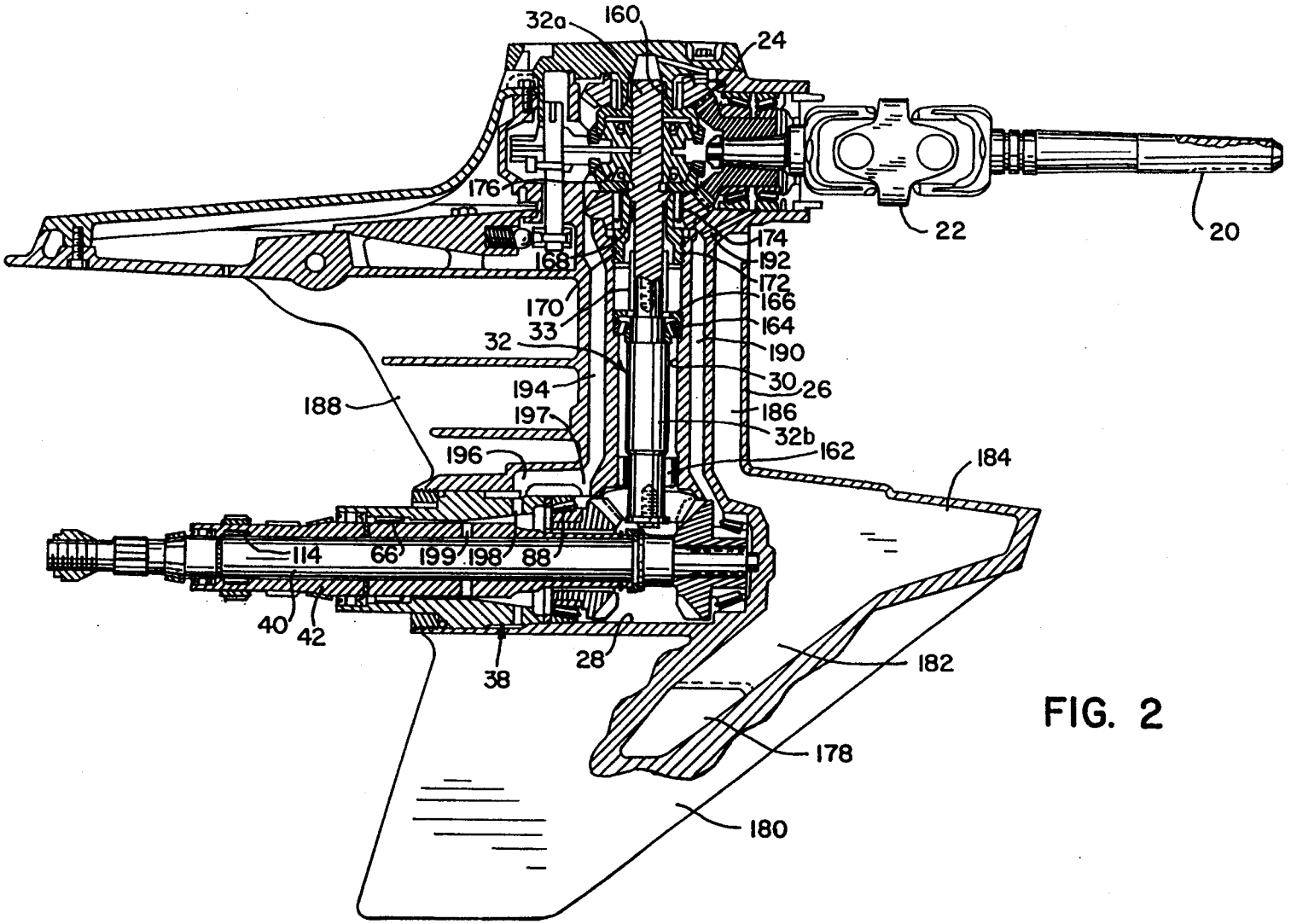
FIG. 2 is a partial sectional view of a portion of the structure of FIG. 1.

FIG. 1 shows a marine drive 10 having two counter-rotating propellers 12 and 14. The drive is mounted to the transom 16 of a boat 18 according to the usual marine stern drive mounting arrangement. An input shaft 20, FIG. 2, is driven by an engine (not shown) in the boat 18. Input shaft 20 is coupled through a universal joint 22 to an upper gear and clutch mechanism 24 which is known in the art, as shown in U.S. Pat. Nos. 4,630,719, 4,679,682, and 4,869,121, incorporated herein by reference. Universal joint 22 allows trimming and steering of the drive.

Figure 4:
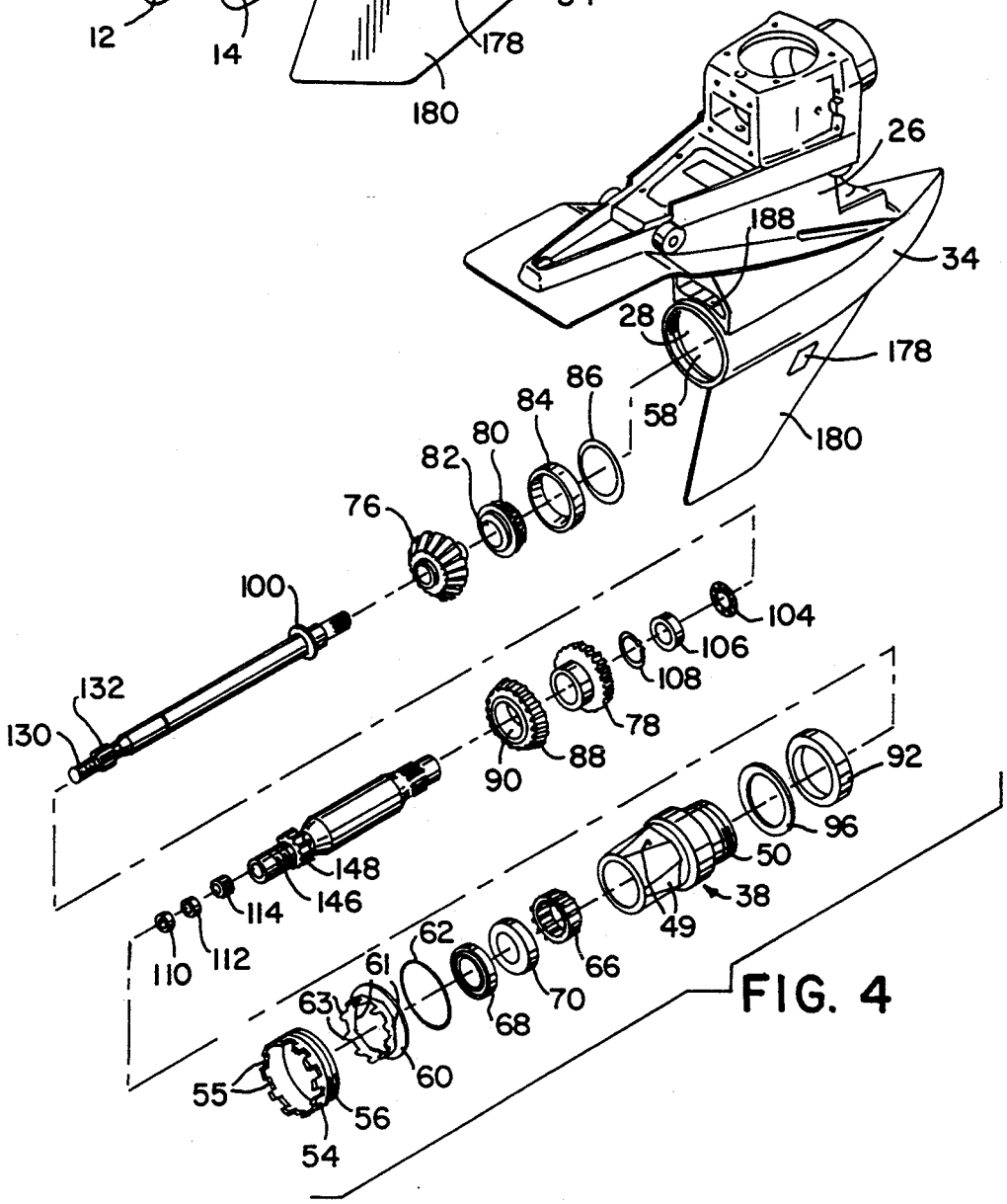
FIG. 4 is an exploded perspective view of a portion of the structure of FIG. 1.
Figure 3:
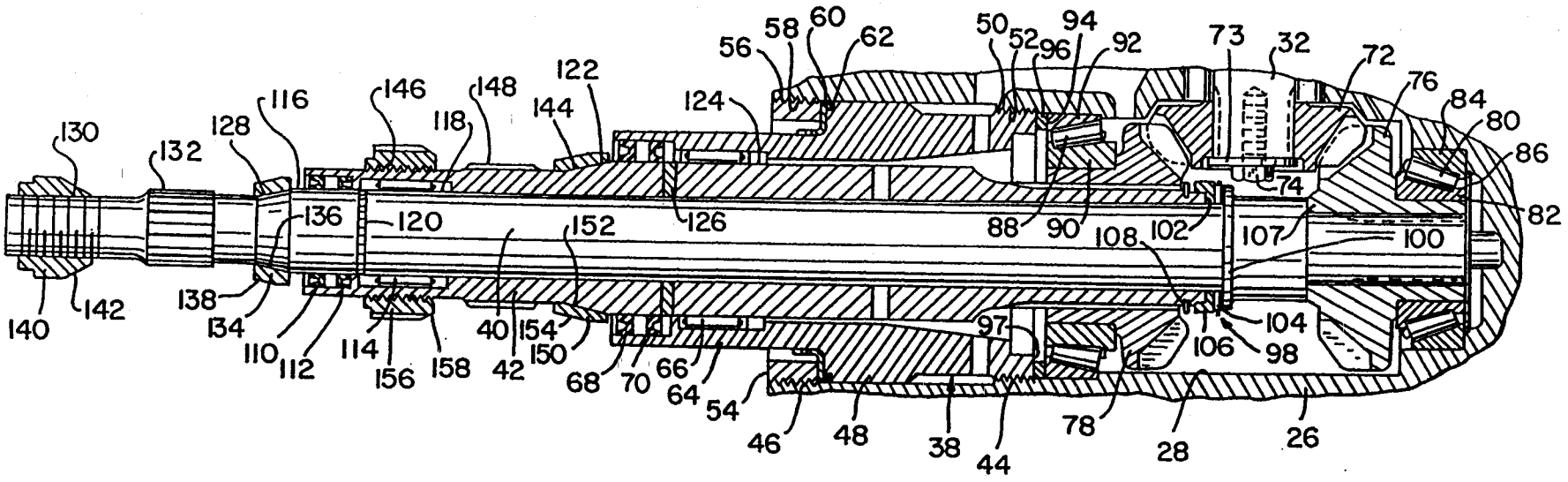
FIG. 3 is an enlarged view of a portion of the structure of FIG. 2.

Drive housing 26 has a horizontal bore 28 and an intersecting vertical bore 30 therein. Upper gear mechanism 24 drives a vertical driveshaft 32 positioned in vertical bore 30. Horizontal bore 28 is in the portion of the drive housing called the torpedo 34, FIG. 4. A spool assembly 38, FIG. 3, is positioned in horizontal bore 28 of housing 26 and supports a first inner propeller shaft 40 and a second hollow outer propeller shaft 42. Propeller shaft 42 is positioned concentrically over propeller shaft 40. The propeller shafts rotate in opposite rotational directions. Propeller 12 is mounted to propeller shaft 40. Propeller 14 is mounted to propeller shaft 42. One of the propellers is a right hand rotating propeller, and the other propeller is a left hand rotating propeller.

Retaining structure is provided for holding the spool assembly 38 fixed for non-rotation within horizontal bore 28 in both rotational directions. The retaining structure is provided by a first right hand thread set 44, FIG. 3, and a second left hand thread set 46. The thread sets are spaced along the rotational axis of the propeller shafts. Right hand thread set 44 prevents right hand rotational loosening of the spool assembly. Left hand thread set 46 prevents left hand rotational loosening of the spool assembly. The spool assembly includes a cylindrical bearing support housing 48, FIGS. 3 and 4, having a mounting thread 50 thereon for engagement with a mounting thread 52 in bore 28 of housing 26. The spool assembly also includes a cylindrical ring locking member 54 having a left hand thread 56 for engagement with a mating thread 58 in bore 28 of housing 26, for clamping against bearing support housing 48 to fix the rotational and axial position of both bearing support housing 48 and locking member 54 in horizontal bore 28, whereby rotation of the spool assembly is prevented in each rotational direction. A locking tab washer 60 is provided between locking member 54 and bearing support housing 48, and O-ring 62 provides a seal between bearing support housing 48 and drive housing 26 preventing entry of water forwardly into bore 28. Flats 61 on washer 60 engage flats 49 on housing 48 to lock the washer 60 against rotation relative to housing 48. Tabs 63 on washer 60 are bent outwardly into slotted recesses 55 on locking member 54 to prevent rotation of member 54 relative to washer 60, which in turn prevents rotation of member 54 relative to housing 48. Housing 48 is then locked into bore 28 by the noted reverse threads 50 and 56. Spool retaining structure using a set screw is known in the prior art, for example U.S. Pat. No. 4,897,058.

The spool assembly includes an aft bearing support portion 64, FIG. 3, extending rearwardly outwardly from housing 26. Needle bearing 66 is positioned between propeller shaft 42 and bearing support housing 48 in extended bearing support portion 64 such that the propeller shafts are supported over a length to prevent bending of the propeller shafts during operation. Bearings in rearwardly extended spool portions are known in the prior art, for example U.S. Pat. No. 4,897,058. One or more seals 68, 70 are positioned between propeller shaft 42 and extended bearing support portion 64 of the spool assembly and aft of bearing 66 to prevent entry of water forwardly into the space between propeller shaft 42 and the spool assembly.

A pinion driving gear 72, FIG. 3, is mounted on the lower end of vertical driveshaft 32 in splined relation and is held thereon by washer 73 and capscrew 74. A fore driven gear 76 is fixed on inner propeller shaft 40 in splined relation and is engaged by pinion gear 72 for drivingly rotating inner propeller shaft 40. An aft driven gear 78 is fixed on outer propeller shaft 42 in splined relation and is engaged by pinion gear 72 for drivingly rotating outer propeller shaft 42 in the opposite rotational direction as inner propeller shaft 40. A tapered roller thrust bearing 80 supports driven gear 76 for rotation in bore 28 of housing 26. Bearing 80 has an inner race 82 engaging gear 76, and an outer race 84 engaging housing 26. A shim 86 may be provided if desired for adjusting axial positioning. A second tapered roller thrust bearing 88 supports the aft driven gear for rotation in bore 28 of housing 26. Bearing 88 has an inner race 90 engaging gear 78, and an outer race 92 engaging housing 26. Outer race 92 has a rearward end portion 94 facing the spool assembly and held thereby against axial movement, to prevent rearward movement of gear 78. Spacer washer 96 is provided between rearward end 94 of outer race 92 and forward end 97 of bearing support housing 48 of spool assembly 38.

A thrust bearing assembly 98, FIG. 3, engages between the propeller shafts such that thrust from outer propeller shaft 42 is transferred to inner propeller shaft 40 during rotation of the propeller shafts in opposite directions. Inner propeller shaft 40 extends through fore driven gear 76 and aft driven gear 78. Outer propeller shaft 42 extends through aft driven gear 78. Inner propeller shaft 40 has an annular shoulder 100 against which the thrust from outer propeller shaft 42 is transferred. Thrust bearing assembly 98 is mounted between shoulder 100 and the forward axial end 102 of outer propeller shaft 42. Thrust bearing assembly 98 is located axially between fore driven gear 76 and aft driven gear 78, such that thrust is transferred from outer propeller shaft 42 to inner propeller shaft 40 at an axial position on the propeller shafts located between gears 76 and 78. Thrust bearing assembly 98 includes a thrust bearing 104 engaging shoulder 100 of inner propeller shaft 40, and an annular cup-shaped thrust member 106 engaging thrust bearing 104 and the forward end 102 of outer propeller shaft 42 to transfer thrust from outer propeller shaft 42 to inner propeller shaft 40. Inner propeller shaft 40 has a forwardly facing annular shoulder 107 engaging the rearwardly facing axial end of fore gear 76, such that forward thrust is transferred from inner propeller shaft 40 to fore driven gear 76 and then to tapered roller thrust bearing 80. Snap ring 108 stops rearward movement of the shafts in the reverse direction. The propeller shafts are allowed to slide fore and aft within their respective gears 76 and 78 along their respective splines, providing a floating shaft arrangement. Thrust bearing assembly 98 is a double speed bearing and accommodates the opposite rotational directions of the propeller shafts.

One or more annular seals 110, 112, FIG. 3, are positioned between inner propeller shaft 40 and outer propeller shaft 42 at the propeller mounting end of propeller shaft 40 such that water is prevented from entering forwardly into the space between the propeller shafts. A needle bearing 114 is positioned between inner propeller shaft 40 and outer propeller shaft 42 and forward of seals 110, 112. Propeller shaft 40 has a stainless steel outer surface 116 rearward of seals 110, 112, and a carbon steel outer surface 118 forward of the seals at bearing 114. In one embodiment, inner propeller shaft 40 is a two piece member formed by a forward carbon steel piece and a rearward stainless steel piece welded to each other at a weld joint 120 between bearing 114 and the seals 110, 112. In another embodiment, inner propeller shaft 40 is a stainless steel member having a carbon steel sleeve therearound at bearing 114. Outer propeller shaft 42 has a stainless steel outer surface 122 rearward of seals 68, 70, and a carbon steel outer surface 124 forward of the seals at bearing 66. In one embodiment, outer propeller shaft 42 is a two piece member formed by a forward carbon steel piece and a rearward stainless steel piece welded to each other at a weld joint 126. In another embodiment, outer propeller shaft 42 is a stainless steel member having a carbon steel sleeve therearound at bearing 66.

Self-centering mounting structure is provided for the propellers on each propeller shaft. Inner propeller shaft 40 has a tapered shoulder outer surface 128, FIG. 3, a threaded outer surface 130 axially spaced rearwardly of tapered outer surface 128, and a driving spline 132 therebetween and drivingly engaging propeller 12 in splined relation. An annular ring 134 of a material, e.g. bronze, non-fretting relative to stainless steel, has an inner tapered surface 136 engaging tapered outer surface 128 of inner propeller shaft 40. Ring 134 has a tapered outer surface 138. An internally threaded nut 140 of a material, e.g. bronze, non-fretting relative to stainless steel, threadingly engages threaded outer surface 130 of inner propeller shaft 40. Nut 140 has a tapered outer surface 142. Propeller 12 is mounted on inner propeller shaft 40 between ring 134 and nut 140 and is engaged forwardly at tapered outer surface 138 of ring 134, and is engaged rearwardly at tapered outer surface 142 of nut 140. Tapers 138 and 142 provide a tight self-centering fit and mounting of the propeller to the propeller shaft. Splines 132 do not provide a tight fit, but merely rotational drive.

Outer propeller shaft 42 has a tapered shoulder outer surface 144, FIG. 3, a threaded outer surface 146 axially spaced rearwardly of tapered outer surface 144, and a driving spline 148 therebetween for drivingly engaging propeller 14 in splined relation. A ring 150 of a material, e.g. bronze, non-fretting relative to stainless steel, has a tapered inner surface 152 engaging tapered outer surface 144 of outer propeller shaft 42. Ring 150 has a tapered outer surface 154. An internally threaded nut 156 of a material, e.g. bronze, non-fretting relative to stainless steel, threadingly engages threaded outer surface 146 of outer propeller shaft 42. Nut 156 has a tapered outer surface 158. Propeller 14 is mounted on outer propeller shaft 42 between ring 150 and nut 156 and is engaged forwardly at tapered outer surface 154 of ring 150, and is engaged rearwardly at tapered outer surface 158 of nut 156. Tapers 154 and 158 provide a tight self-centering fit. Splines 148 do not provide a tight fit, but only rotational drive.

Vertical driveshaft 32, FIG. 2, is a two-piece member formed by an upper driveshaft segment **32*a* and a lower driveshaft segment 32*b* coupled by a sleeve 33 in splined relation for example as shown in incorporated U.S. Pat. No. 4,869,121. Upper driveshaft segment 32*a*, FIG. 2, is supported at its top end by a needle bearing 160 as in the above incorporated patents. Lower driveshaft segment 32*b* is supported at its lower end by a needle bearing 162. Driveshaft 32 is centrally supported at the upper end of lower segment 32*b* in bore 30 by tapered roller thrust bearing 164 retained by threaded ring 166. Upper segment 32*a* is also supported by needle bearing 168 in upper spool 170 mounted at threads 172 in bore 30, and also having a needle bearing 174 supporting gear 176 of upper gear assembly 24**.

Cooling water for the engine is supplied from water intake 178 in skeg 180. The water flows through skeg passage 182, torpedo nose passage 184 and then through housing passage 186 and then to the engine in the usual manner. After cooling the engine, the water and the engine exhaust are exhausted in the usual manner through an exhaust elbow and through the drive housing and are discharged at exhaust outlet 188 above torpedo 34 and into the path of the propeller blades in the upper portion of their rotation, as in U.S. Pat. No. 4,871,334. In an alternate embodiment, the exhaust is discharged through the transom, and not through the drive. Oil circulates from the lower gears upwardly through passages 190 and 192 to the upper gears and then downwardly through passage 194 to the lower gears at passages 196 and 197. Passage 196 supplies oil through passage 198 in the spool assembly to bearings 88 and 66, and through passage 199 in outer propeller shaft 42 to bearing 114. Passage 197 supplies oil to the forward end of bearing 88.

Figure 5:
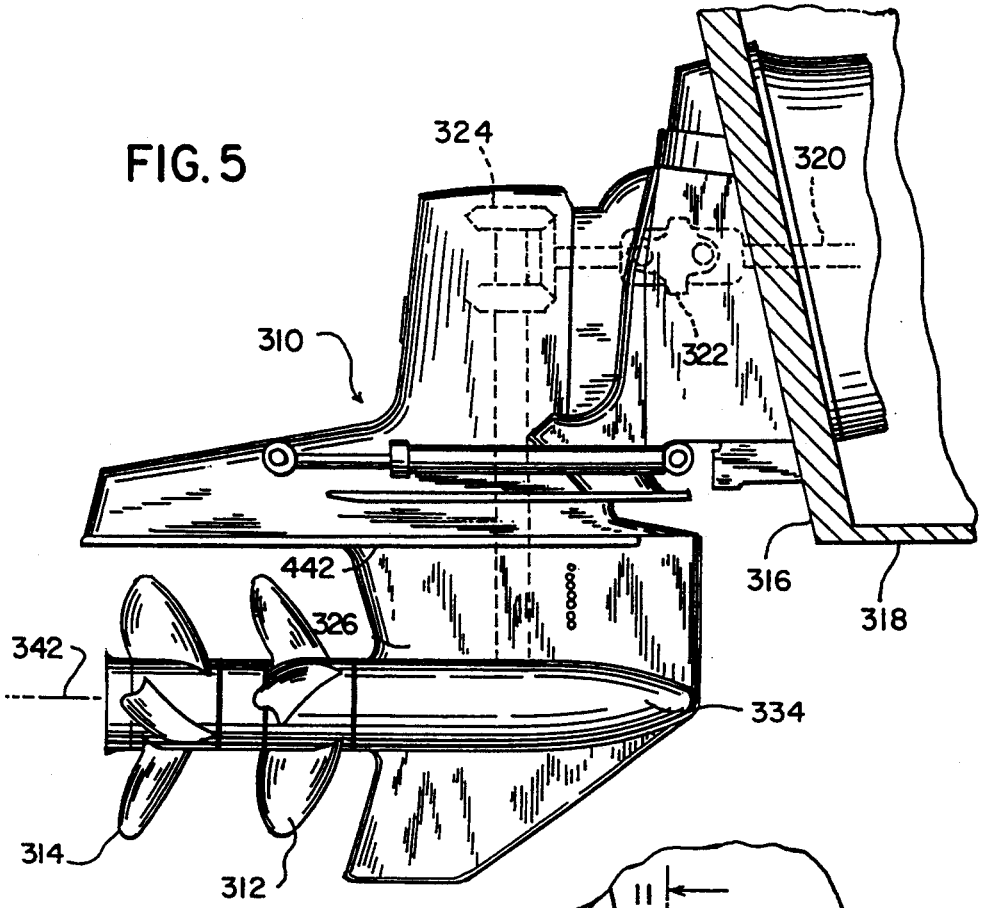
FIG. 5 is a side elevation view of a marine drive in accordance with another embodiment of the invention.

FIG. 5 shows a marine drive 310 having two counter-rotating propellers 312 and 314. The drive is mounted to the transom 316 of a boat 318 according to the usual marine stern drive mounting arrangement. An input shaft 320 is driven by an engine (not shown) in the boat. Input shaft 320 is coupled through a universal joint 322 to an upper gear and clutch mechanism 324 which is known in the art, as shown in U.S. Pat. Nos. 4,630,719, 4,679,682, and 4,869,121, incorporated herein by reference. Universal joint 322 allows trimming and steering of the drive. Drive housing 326 has a lower horizontal bore 328, FIG. 6, and an intersecting vertical bore 330 therein. Upper gear mechanism 324 drives a vertical drive shaft 332, as shown in incorporated U.S. Pat. No. 4,869,121, positioned in vertical bore 330. Horizontal bore 328 is in the portion of the drive housing called the torpedo 334, FIG. 5.

A spool 336, FIGS. 4–10, is positioned in horizontal bore 328 and supports a dual propeller shaft assembly, including a hollow outer propeller shaft 338 positioned in spool 336, and an inner propeller shaft 340 positioned in outer propeller shaft 338. The inner and outer propeller shafts are concentric and rotate in opposite rotational directions along a common axis 342. Spool 336 is a cylindrical member having a forward first outer diameter portion 344, FIG. 10, threadingly engaging housing 326 within horizontal bore 328 at thread set 346, FIG. 7. The spool includes a second reduced outer diameter portion 348, FIG. 10, within horizontal bore 328, FIGS. 6 and 7, and aft of first outer diameter portion 344, FIG. 10, and defining an annular recess 350, FIGS. 6 and 7. Spool 336 includes a third outer diameter portion 352, FIG. 10, aft of second outer diameter portion 348 and engaging drive housing 326 at the aft end 354, FIG. 7, of horizontal bore 328. Third outer diameter portion 352 has a plurality of slots 356, 358, 360, 362, FIGS. 7–9 and 11, extending rearwardly therethrough. Spool 336 has a fourth reduced outer diameter portion 364 aft of third outer diameter portion 352 and external of horizontal bore 328.

Figure 7:
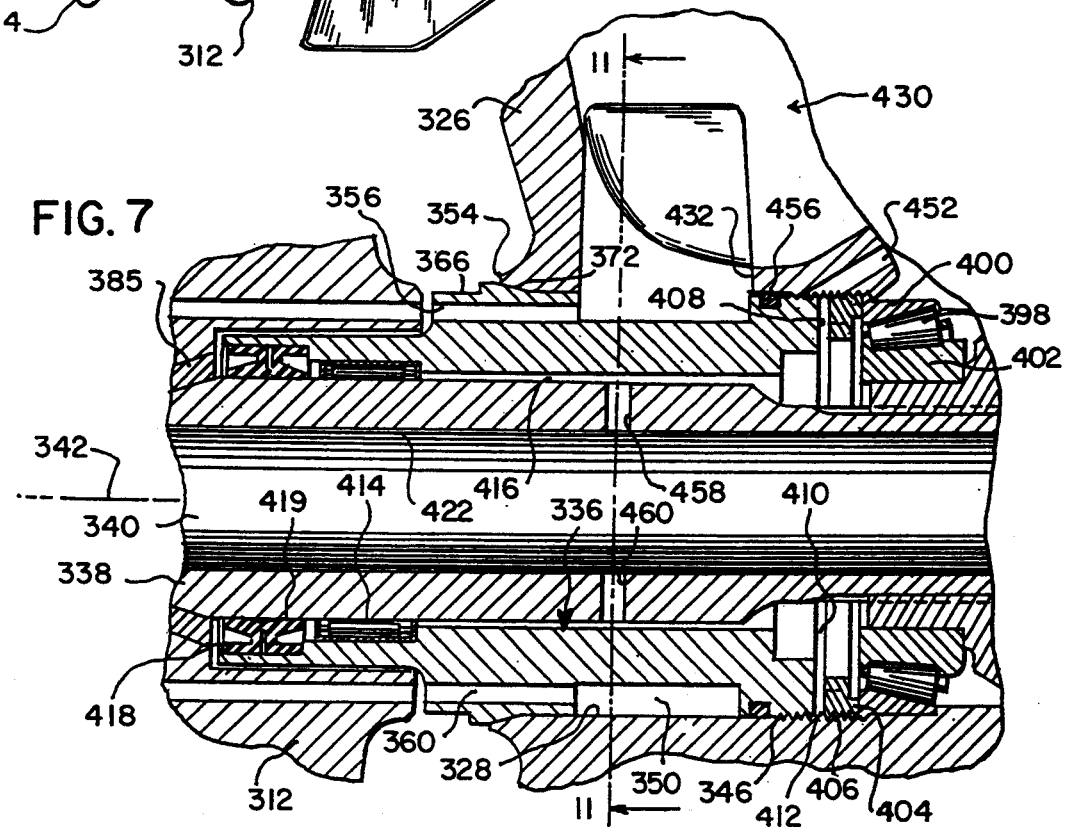
FIG. 7 is an enlarged partial sectional view of a portion of the structure of FIG. 6.
Figure 10:
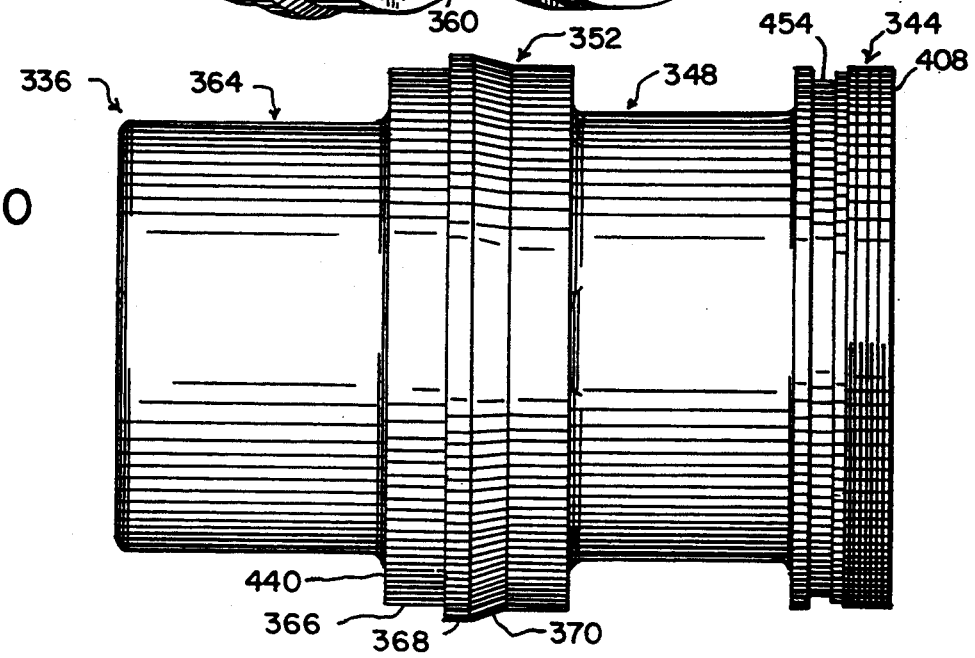
FIG. 10 is a side elevation view of the spool of FIGS. 8 and 9.
Figure 11:
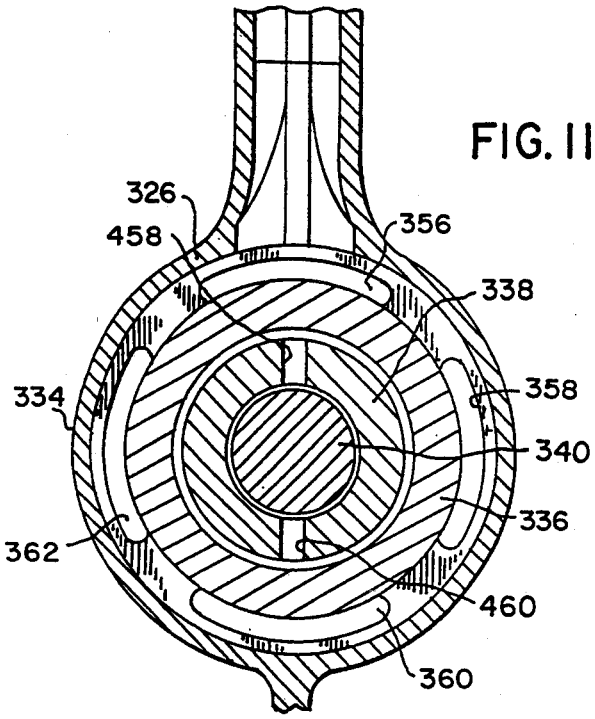
FIG. 11 is a sectional view taken along line 11—11 of FIG. 7.
Figure 12:
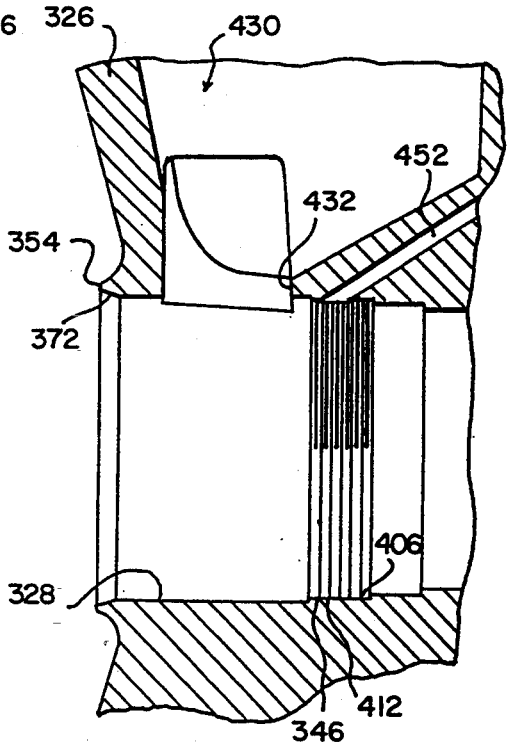
FIG. 12 is a section view of a portion of the structure of FIG. 7 with parts removed.
Figure 13:
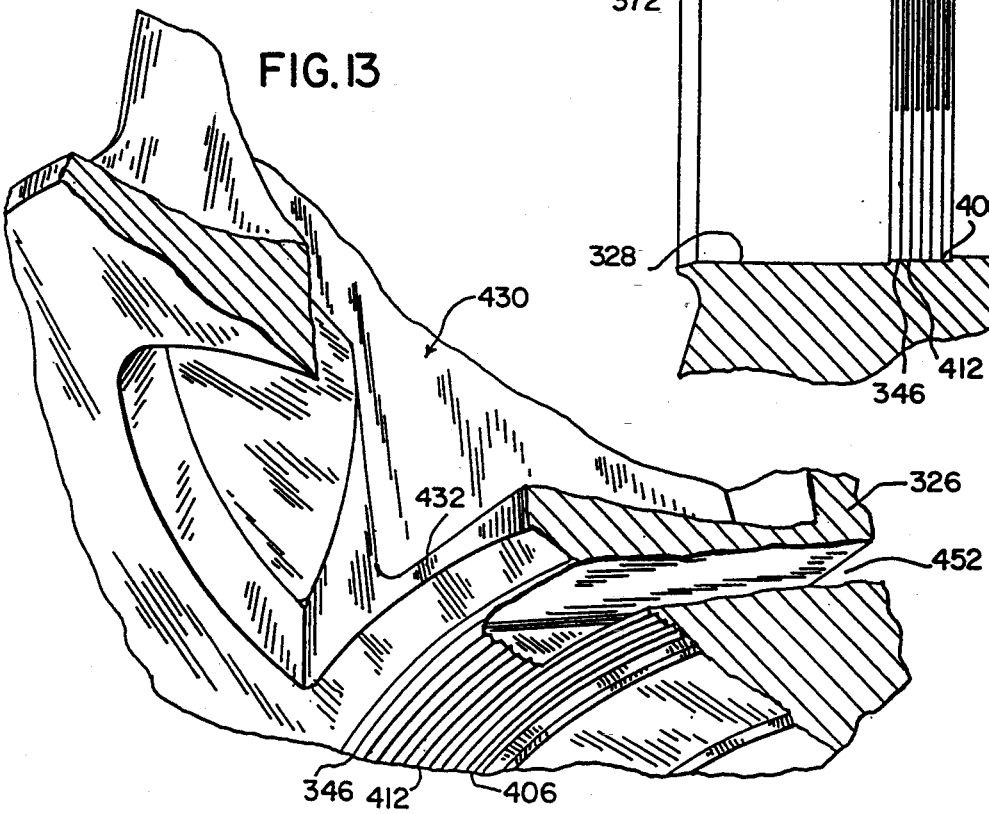
FIG. 13 is an enlarged perspective view of a portion of the structure of FIG. 12.

Third outer diameter portion 352 of spool 336 extends rearwardly at 366, FIGS. 10 and 7, externally of horizontal bore 328. Third outer diameter portion 352 includes a raised annular shoulder 368 of outer diameter greater than the inner diameter of horizontal bore 328 and engaging housing 326 at aft end 354 of horizontal bore 328. Raised annular shoulder 368 has a forward portion 370, FIG. 10, tapered forwardly to reduced outer diameters. Horizontal bore 328 at aft end 354 is tapered at 372, FIG. 7, rearwardly to increasing inner diameters and snugly engages forward tapered portion 370 of raised annular shoulder 368 in flush relation.

Figure 6:
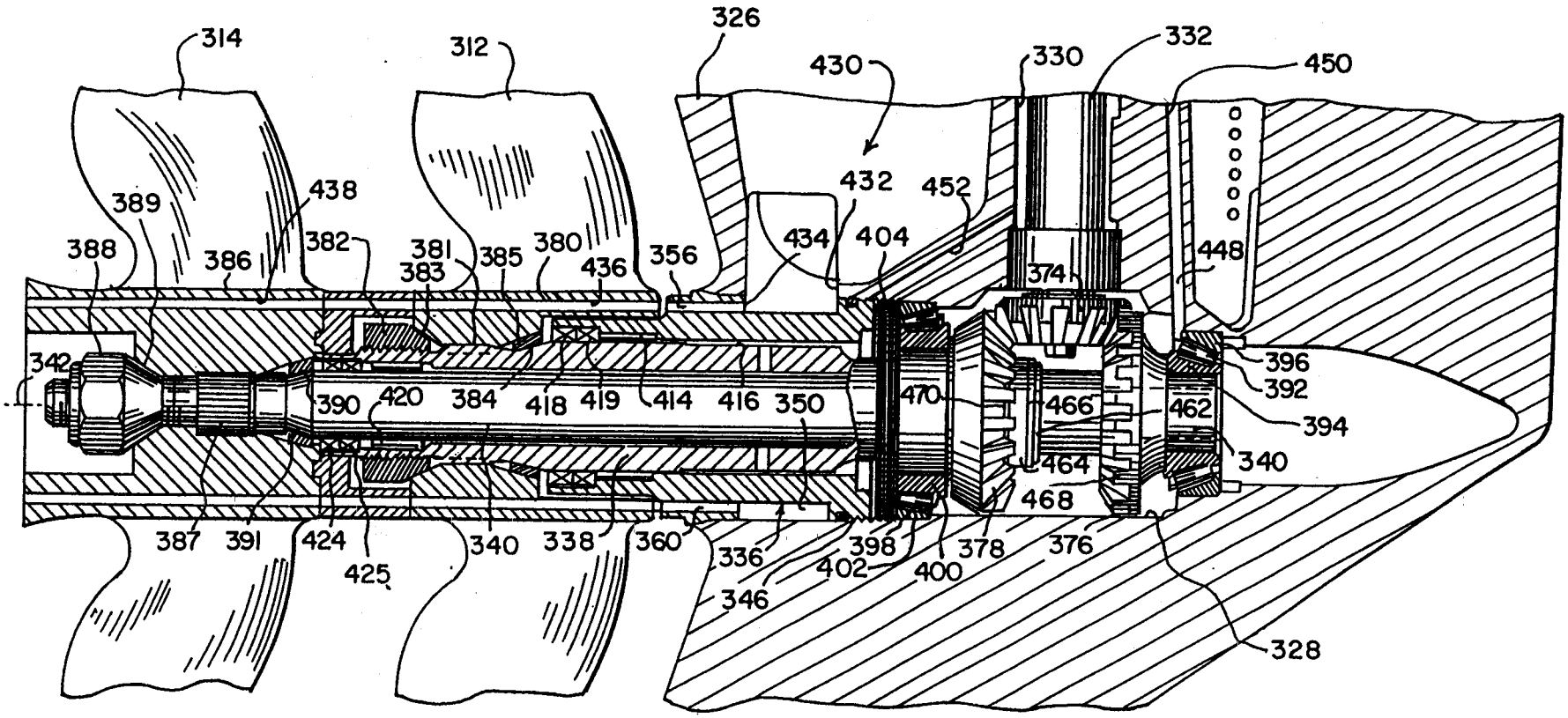
FIG. 6 is an enlarged partial sectional view of a portion of the structure of FIG. 5.
Figure 8:
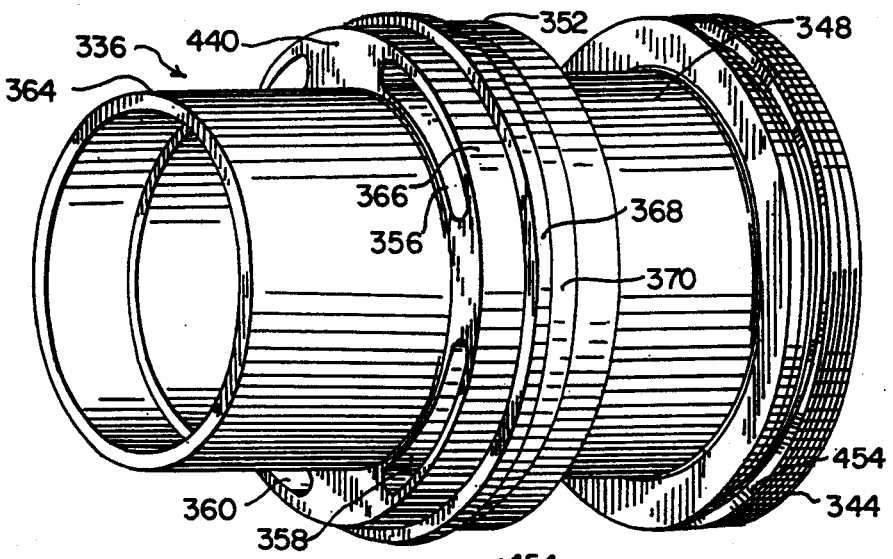
FIG. 8 is a perspective view of the spool of FIG. 7.
Figure 9:
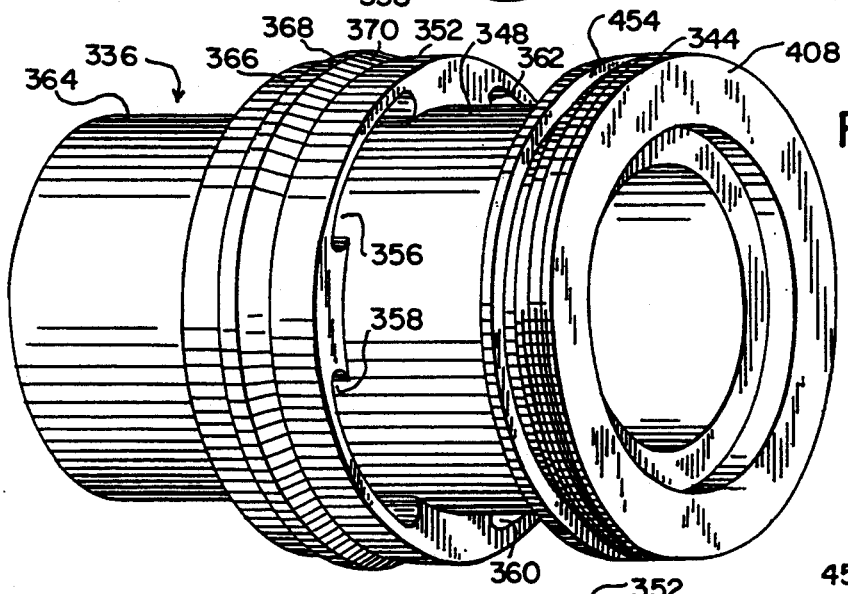
FIG. 9 is another perspective view of the spool of FIG. 8.

A pinion driving gear 374, FIG. 6, is mounted on the lower end of vertical drive shaft 332, as is standard. A first driven gear 376 is fixed on inner propeller shaft 340 in splined relation and is engaged by pinion gear 374 and drivingly rotates inner propeller shaft 340 in a first rotational direction. A second driven gear 378 is fixed on outer propeller shaft 338 in splined relation and is engaged by pinion gear 374 and drivingly rotates outer propeller shaft 338 in a second opposite rotational direction, as is standard. Self-centering mounting structure is provided for the propellers on each propeller shaft, as above. Forward propeller 312 has a hub 380 mounted to outer propeller shaft 338 at splines 381 and is held thereon by threaded nut 382 and is axially engaged between and against tapered engagement surfaces 383 and 384 respectively on tapered nut 382 and tapered thrust hub ring 385 on outer propeller shaft 338. Tapers 383 and 384 provide a tight self-centering fit and mounting of the propeller to the propeller shaft. Splines 381 do not provide a tight fit, but merely rotational drive. Aft propeller 314 has a hub 386 mounted to inner propeller shaft 340 at splines 387 and is held thereon by threaded nut 388 and is axially engaged between and against tapered engagement surfaces 389 and 390 respectively on tapered nut 388 and tapered thrust hub ring 391 on inner propeller shaft 340. Tapers 389 and 390 provide a tight self-centering fit and mounting of the propeller to the propeller shaft. Splines 387 do not provide a tight fit, but merely rotational drive. In the preferred embodiment, spool 336 is mounted by left hand threads 346 in the housing, and forward propeller 312 is a left hand rotation propeller, and aft propeller 314 is a right hand rotation propeller.

A forward tapered roller thrust bearing 392 supports forward driven gear 376 in the housing, and includes an inner race 394 engaging gear 376, and an outer race 396 engaging housing 326 in bore 328. An aft tapered roller thrust bearing 398 supports aft driven gear 378 in the housing, and includes an inner race 400 engaging gear 378 and an outer race 402 engaging housing 326 in bore 328. A threaded locking ring 404, FIGS. 6 and 7, is thread mounted within horizontal bore 328 at thread set 406 and engages outer race 402 to prevent rearward movement of driven gear 378 and to adjust loading of same.

Thread set 346, mounting spool 336, FIG. 7, and thread set 406 mounting locking ring 404 are axially spaced such that the forward end 408 of spool 336 is spaced rearwardly of locking ring 404 by an axial gap 410 therebetween. Thread sets 346 and 406 may be separate threads, however it is preferred that they be provided by a continuous thread cut into horizontal bore 328 and having a forward portion at 406 for mounting locking ring 404, an aft portion at 346 for mounting spool 336, and a middle portion at 412 at axial gap 410. This enables a single machining threading operation to provide both thread sets 346 and 406.

A first aft bearing 414, FIGS. 6 and 7, within a first annulus 416 between outer propeller shaft 338 and spool 336 supports the outer propeller shaft for rotation within the spool. Annular seal 418 aft of bearing 414 prevents entry of water forwardly into annulus 416. Annular seal 419 prevents exit of lubricant rearwardly from annulus 416. A second aft bearing 420 in a second annulus 422 between inner propeller shaft 340 and outer propeller shaft 338 supports the inner propeller shaft for rotation within the outer propeller shaft. Annular seal 424 aft of bearing 420 prevents entry of water forwardly into annulus 422. Annular seal 425 prevents exit of lubricant rearwardly from annulus 422.

An engine exhaust passage 430, FIG. 6, is provided by a passage 432 in housing 326 communicating with horizontal bore 328 at spool 336. The exhaust passage continues at 434 through annular recess 350 provided by second outer diameter portion 348 of spool 336, and then rearwardly through slot passages 356, 358, 360, 362. The exhaust then passes rearwardly through hub exhaust passages 436 and 438 of the forward and aft propeller hubs 380 and 386. The exhaust passage at 434 includes a forward portion at recess 350 receiving exhaust from passage 430, and an aft portion at slots 356, 358, 360, 362 extending rearwardly from recess 350 toward and axially aligned with through-hub exhaust passages 436, 438. Third outer diameter portion 352 of spool 336 has an aft end 440, FIG. 10, defining an annulus facing axially rearwardly toward hub 380 of forward propeller 312. Fourth outer diameter portion 364 of spool 336 extends rearwardly within hub 380, and exhaust through hub 380 is concentric around fourth outer diameter portion 364. In the preferred embodiment, the plurality of arcuate slots 356, 358, 360, 362 have a cumulative area of at least about two square inches for a 502 cubic inch displacement engine. Further in the preferred embodiment, additional exhaust outlets from passage 430 are provided in the area of anti-cavitation plate 442, as is known, for additional exhaust relief if desired.

Positive pressure gradients at area 448, FIG. 6, provides an oil pumping function, for which further reference may be had to incorporated allowed application Ser. No. 07/892,399, filed May 28, 1992, to circulate oil upwardly through oil passage 450 to upper gear mechanism 324, FIG. 5, which oil is returned through vertical bore 330. Housing 326 includes an oil passage 452, FIGS. 6, 7, 12, 13, extending from vertical bore 330 and communicating with horizontal bore 328 forwardly of exhaust passage 432. Oil passage 452 lubricates the dual propeller shaft assembly.

Spool 336 includes an annular groove 454 at first outer diameter portion 344, and has an annular O-ring seal 456, FIG. 7, in groove 454 and engaging housing 326 within horizontal bore 328 at a location axially between passages 432 and 452, and sealing passage 432 from passage 452, to thus prevent exhaust from entering the oil flow passages, and vice versa. Seal 456 is also axially between passage 432 and thread set 346. At least a portion of thread set 346 is axially between seal 456 and passage 452. Passage 452 communicates with horizontal bore 328 at axial gap 410. Oil passage 452 supplies oil to annulus 416 through gap 410, to lubricate bearing 414. Outer propeller shaft 338 has radial passages 458, 460 therethrough, providing oil passages supplying oil from annulus 416 to annulus 422 to lubricate bearing 420. Oil passages 458, 460 are spaced radially inwardly of exhaust passages 432, 350, 356, 358, 360, 362. Seal 456 is forward of oil passages 458, 460.

A thrust bearing 462, FIG. 6, engages between the propeller shafts such that thrust from outer propeller shaft 338 is transferred to inner propeller shaft 340 during rotation of the propeller shafts in opposite directions, as above. Inner propeller shaft 340 extends through fore driven gear 376 and aft driven gear 378. Outer propeller shaft 338 extends through aft driven gear 378. Inner propeller shaft 340 has an annular shoulder 464 against which the thrust from outer propeller shaft 338 is transferred. Thrust bearing 462 is mounted between shoulder 464 and the forward axial end 466 of outer propeller shaft 338. Thrust bearing 462 is located axially between fore driven gear 376 and aft driven gear 378, such that thrust is transferred from outer propeller shaft 338 to inner propeller shaft 340 at an axial position on the propeller shafts located between gears 376 and 378. Inner propeller shaft 340 has a forwardly facing annular shoulder 468 engaging fore driven gear 376, such that the thrust is then transferred from inner propeller shaft 340 to fore driven gear 376 and then to tapered roller thrust bearing 392. The propeller shafts are allowed to slide fore and aft within their respective gears 376 and 378 along their respective splines, providing a floating shaft arrangement. Thrust bearing 462 is a double speed bearing and accommodates the opposite rotational directions of the propeller shafts. Snap ring 470 prevents rearward movement of shaft 340.

It is recognized that various equivalents, alternatives and modifications are possible within the scope of the appended claims. Various of the principles of each embodiment are applicable to both surfacing and submerged drives, i.e. to both surface-operating propellers and to submerged-operation propellers.

We claim:

1. A marine drive comprising:

a housing having a horizontal bore and an intersecting vertical bore therein;

a first inner propeller shaft;

a second hollow outer propeller shaft positioned over said first propeller shaft so as to form a dual propeller shaft assembly, said dual propeller shaft assembly positioned in said horizontal bore, said first propeller shaft counter-rotating with respect to said second propeller shaft;

a vertical driveshaft positioned in said vertical bore;

a pinion driving gear mounted on the lower end of said vertical driveshaft;

a fore driven gear on said first inner propeller shaft and engaged by said pinion gear to drivingly rotate said first propeller shaft in a first rotational direction;

an aft driven gear on said second propeller shaft and engaged by said pinion gear to drivingly rotate said second propeller shaft in a second rotational direction;

a tapered roller bearing supporting said aft driven gear for rotation in said housing, said tapered roller bearing having an inner race engaging said aft driven gear, and an outer race engaging said housing;

a threaded locking member engaging said housing in thread mounted relation within said horizontal bore and holding said tapered roller bearing in place and preventing rearward movement of said tapered roller bearing and said aft driven gear;

said threaded locking member is thread mounted at a thread set within said horizontal bore, and comprising a passage in said housing communicating with said horizontal bore aft of said thread set.

2. The invention according to claim 1 comprising a second passage in said housing communicating with said horizontal bore forwardly of said first mentioned passage.

3. A marine drive comprising:

a housing having a horizontal bore and an intersecting vertical bore therein;

a first inner propeller shaft;

a second hollow outer propeller shaft positioned over said first propeller shaft so as to form a dual propeller shaft assembly, said dual propeller shaft assembly positioned in said horizontal bore, said first propeller shaft counter-rotating with respect to said second propeller shaft;

a vertical driveshaft positioned in said vertical bore;

a pinion driving gear mounted on the lower end of said vertical driveshaft;

a fore driven gear on said first inner propeller shaft and engaged by said pinion gear to drivingly rotate said first propeller shaft in a first rotational direction;

an aft driven gear on said second propeller shaft and engaged by said pinion gear to drivingly rotate said second propeller shaft in a second rotational direction;

a tapered roller bearing supporting said aft driven gear for rotation in said housing, said tapered roller bearing having an inner race engaging said aft driven gear, and an outer race engaging said housing;

a threaded locking member engaging said housing in thread mounted relation within said horizontal bore and holding said tapered roller bearing in place and preventing rearward movement of said tapered roller bearing and said aft driven gear;

a passage in said housing communicating with said horizontal bore, a spool in said housing supporting said dual propeller shaft assembly, said spool having a first outer diameter portion engaging said housing within said horizontal bore, and a second reduced outer diameter portion within said horizontal bore and aft of said first outer diameter portion and defining an annular recess, wherein said passage communicates with said horizontal bore at said annular recess.

4. The invention according to claim 3 wherein said spool comprises a third outer diameter portion aft of said second outer diameter portion and engaging said housing.

5. The invention according to claim 3 wherein said spool has a forward end engaging said housing in threaded relation with said horizontal bore and providing said locking member.

* * * * *